United States Patent [19]

Lonati

[11] 3,969,911

[45] July 20, 1976

[54] TOE CLOSER

[75] Inventor: Francesco Lonati, Brescia, Italy

[73] Assignee: Costruzioni Meccaniche Lonati di Lonati Francesco & Figli (Ettore, Faust, Tiberio) S.n.c., Bresica, Italy

[22] Filed: Jan. 31, 1975

[21] Appl. No.: 545,869

[30] Foreign Application Priority Data

Feb. 6, 1974 Italy ..... 20229/74

[52] U.S. Cl. ..... 66/95; 66/14; 66/28

[51] Int. Cl.[2] ..... D04B 15/02

[58] Field of Search ..... 66/14, 28, 26, 95, 24

[56] References Cited

UNITED STATES PATENTS

| | | | |
|---|---|---|---|
| 1,441,123 | 1/1923 | Scott | 66/28 |
| 3,340,707 | 9/1967 | Currier | 66/26 |
| 3,838,583 | 10/1974 | Rumi et al. | 66/95 |
| 3,841,113 | 10/1974 | Lucke et al. | 66/95 |

FOREIGN PATENTS OR APPLICATIONS

| | | | |
|---|---|---|---|
| 48,953 | 7/1988 | Germany | 66/24 |
| 29,026 | 1910 | United Kingdom | 66/14 |
| 488,624 | 7/1938 | United Kingdom | 66/14 |

*Primary Examiner*—Louis K. Rimrodt
*Assistant Examiner*—Andrew M. Falik
*Attorney, Agent, or Firm*—Guido Modiano; Albert Josif

[57] ABSTRACT

A circular knitting machine for stockings, particularly for the manufacture of stockings closed at the toe directly on the machine, having a coupling joint for disengaging the lower needle cylinder from the upper needle cylinder or from the welt dial. The coupling joint consists of a substantially flanged element rigid with the shaft driving the lower needle cylinder and of a gear wheel mounted idly and axially displaceable on the shaft. The gear wheel engages with a corresponding crown gear for rotation of the upper needle cylinder or the welt dial. The flanged element and the gear wheel have means for mutual engagement and the machine further comprises means for the axial displacement of the gear wheel to disengage it from the flanged element, these means being responsive to the machine program.

9 Claims, 6 Drawing Figures

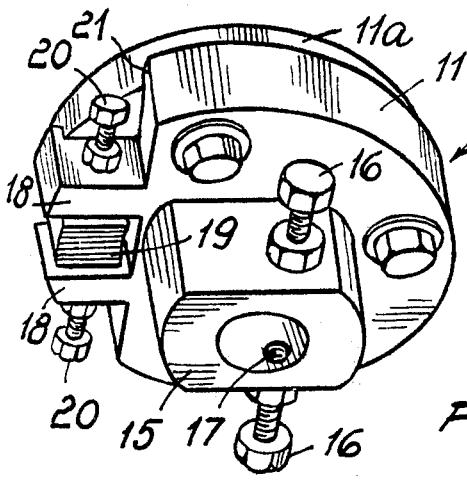
Fig.3
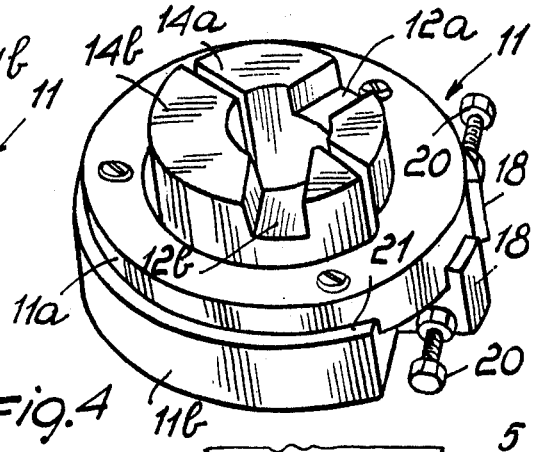
Fig.4
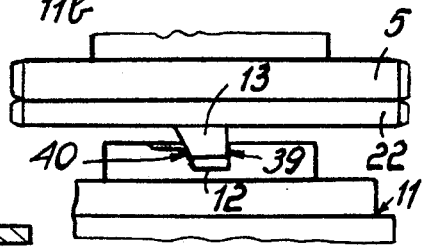
Fig.5
Fig.6
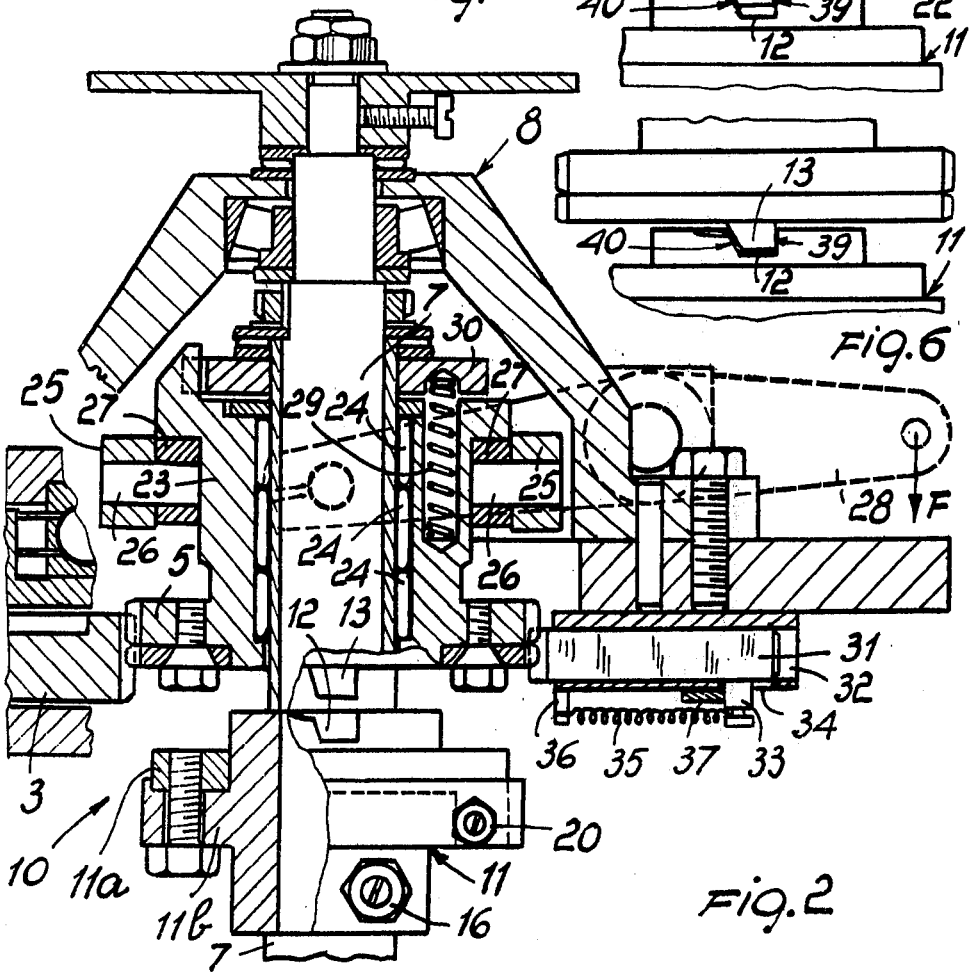
Fig.2

TOE CLOSER

BACKGROUND OF THE INVENTION

The present invention relates to a circular knitting machine for stockings, particularly for the manufacture of stockings closed at the toe directly on the machine.

For the closing of stockings, panty hose, men's socks or the like at the toe there is known a method including the formation of a double fabric at the toe, by withholding a part of the loops with selected needles in the upper needle cylinder of a double cylinder knitting machine or with the hooks of the welt dial in the case of a single cylinder machine, and forming with the needles in the lower needle cylinder a pocket which is then subjected to a torsion by means of a temporary rotation of the lower needle cylinder relative to the upper needle cylinder or to the welt dial before bringing back to the lower needle cylinder the loop withheld so as to form a double fabric tightened at the toe.

The most relevant problem in this case is felt when having to carry out the relative rotation between the cylinders of the machine or between the lower cylinder and the welt dial in a rapid and precise manner so as to have the grooves of the needles perfectly aligned in both cylinders for the execution of the subsequent step even after the relative rotation of the cylinders.

In order to carry out the above mentioned relative rotation, at present it is customary to stop the upper needle cylinder or the welt dial while the rotation of the lower needle cylinder continues. For this purpose, there is provided a coupling between the drive shaft and the gear wheel which meshes with the corresponding crown gear rigid with the upper cylinder or welt dial so that the above mentioned gear wheel may axially slide on the shaft and be disengageable from the crown gear of the upper needle cylinder or welt dial. The frequency with which the operation of engagement and disengagement must be carried out for each stocking or the like and the stresses which arise each time, give rise to a fast wear of the mechanical coupling means, particularly between the gear wheel and the drive shaft. This fact together with the limited coupling surfaces and their closeness to the rotational axis, causes large alignment errors between the needles even in the case of small degrees of wear of the coupling means, with disastrous results for the machine itself.

According to another solution, the gear wheel meshing with the gear crown of the upper needle cylinder is not axially displaceable on the drive shaft but is mounted axially not displaceable and rotationally idly on the same shaft and there is provided a sleeve member axially slidable along the shaft and rotationally connected to it. This sleeve member has one or more teeth insertable in corresponding slots arranged angularly spaced on a body rigid with the gear wheel. The axial displacement of the sleeve member, which displacement causes the disengagement and engagement between the teeth of the sleeve element and the slots of the gear wheel and therefore between the drive shaft and the gear wheel, is operated by means of a lever system controlled by the machine program.

Even this solution is not however free of the drawbacks mentioned for the preceding solution, since the coupling between the sliding sleeve member and the drive shaft nevertheless occurs between small coupling surfaces and very close to the rotational axis with the consequences already mentioned.

SUMMARY OF THE INVENTION

The main object of the present invention is to provide a circular knitting machine for stockings with a device for the relative rotation between the needle cylinders or between the needle cylinder and the welt dial, this device having a structure such as to minimize the errors due to wear and allowing to maintain even after long periods of operation the perfect alignment between the needles (or the hooks and the needles) necessary for achieving the closing operation at the toe.

Another object of the present invention is to provide a device in which a possible wear after long periods of operation may easily be overcome by a simple adjustment carried out in a precise and rapid way.

A further object of the invention is to provide a device which may be applied to conventional machines without substantial modifications.

These and other objects are attained by a circular knitting machine for stockings with a lower needle cylinder and an upper needle cylinder, or a needle cylinder and respectively a welt dial, rotationally operated by corresponding gear wheels arranged on a common drive shaft, as well as a coupling joint between at least one of said gear wheels and said drive shaft, wherein said coupling joint comprises a substantially flanged element rigid with said drive shaft and provided with means for removable engagement with said gear wheel and said gear wheel is mounted idly and axially displaceable on said drive shaft, the machine further comprising means for the axial displacement of said gear wheel to a position of disengagement from said substantially flanged element, said means being responsive to the machine program.

BRIEF DESCRIPTION OF THE DRAWINGS

Further characteristics and advantages of the invention will be more evident from the following description of a preferred embodiment of a circular knitting machine for stockings according to the invention illustrated by way of example in the accompanying drawings, in which:

FIG. 2 is an enlarged view, partly in section, of the device for the engagement and disengagement of one cylinder with respect to the other;

FIGS. 3 and 4 are respectively a perspective view from below and from above the substantially flanged element forming the coupling joint;

FIGS. 5 and 6 show schematically the manner in which the plays occurring in the coupling means, due to wear, are eliminated.

DESCRIPTION OF THE PREFERRED EMBODIMENT

Figure 1:
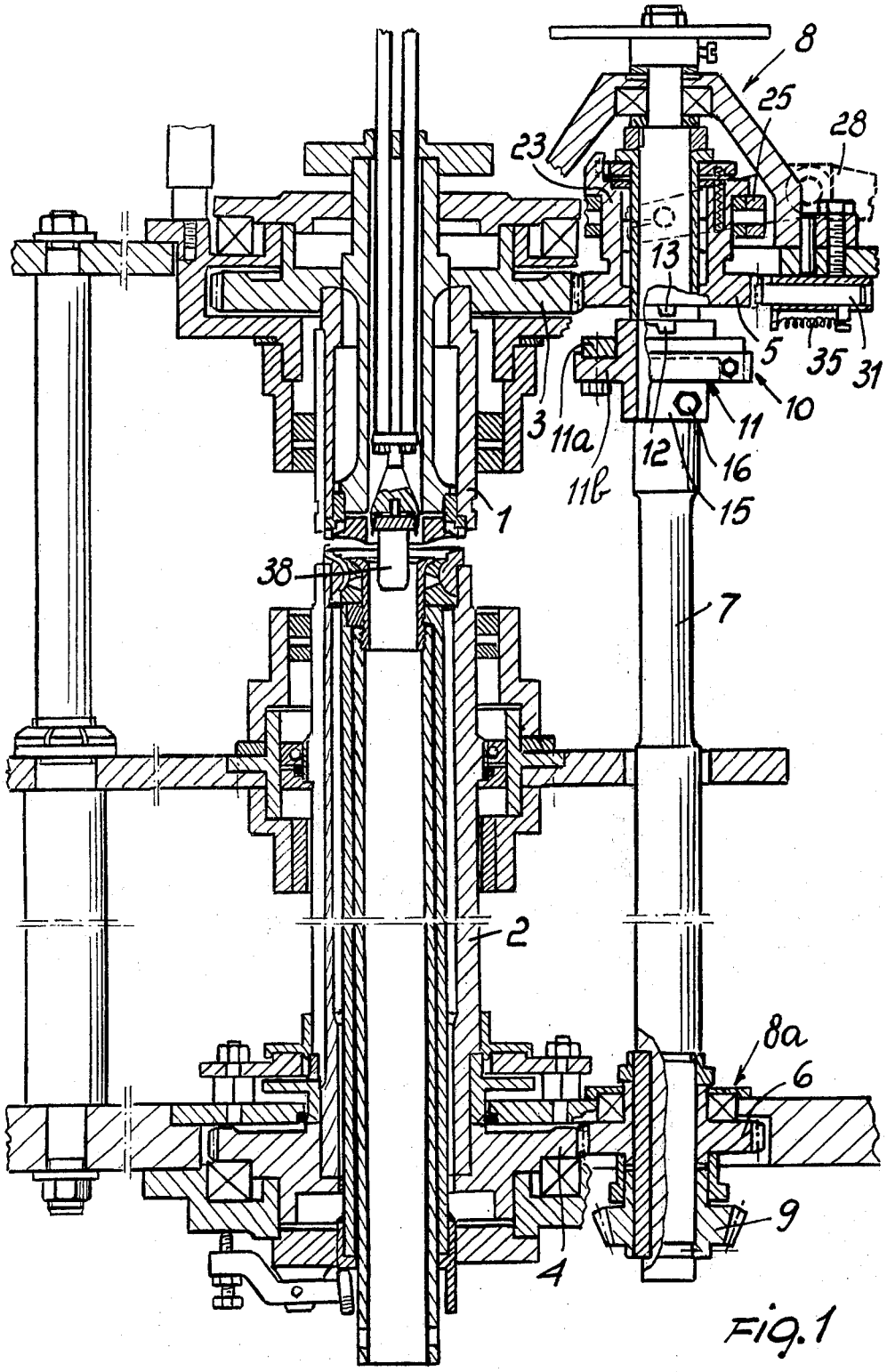
FIG. 1 is an axial vertical section of a circular knitting machine according to the invention, the machine being for example of the double cylinder type.

The circular knitting machine according to the invention comprises an upper needle cylinder 1 and a lower needle cylinder 2, rigidly associated to crown gears 3 and 4 respectively rotated by respective crown gears 5, 6 arranged on a common drive shaft 7. The gear ratio is preferably such that at each revolution of the drive shaft 7 there corresponds a half revolution of the cylinders. The drive shaft 7 is supported by the supports 8 and **8*a* and receives rotational motion from the bevel gear 9** operated, in a well known manner, by the machine driving means, not shown. The structure of the machine comprises furthermore other elements of conventional type which do not form part of the invention and are not here described even if represented in the drawings.

The machine also comprises a coupling joint generally indicated with the numeral 10 and situated in correspondence to the upper needle cylinder 1, for disengaging, during particular knitting steps, the upper needle cylinder 1 from the lower needle cylinder 2 and for maintaining the two cylinders in synchronous rotation during other knitting steps. A double cylinder knitting machine is presently being considered, in which the upper needle cylinder 1 defines an upper support structure for knitting elements in the form of needles and in which the lower needle cylinder 2 defines a lower support structure for knitting elements in the form of needles. It is, however, understood that also a single cylinder machine may be considered having a welt dial instead of the upper needle cylinder 1 that is a machine as described in French Pat. No. 1,583,338. In this case the upper support structure herebefore defined will be the welt dial and the knitting elements will be the hooks provided thereon which cooperate with the needles of the single cylinder during the toe closure as initially explained, while the single needle cylinder will define the lower support structure having needles as knitting elements.

The joint 10 comprises a substantially flanged element rigid with the shaft 7 and provided with at least a slot 12 on the side facing the gear wheel 5, which is idly mounted and axially displaceable along the shaft 7. A dog 13 rotationally rigid with the gear wheel 5 is provided for engaging with the slot 12. When the dog has penetrated the slot 12, in the manner that will be seen hereinafter, there is established a direct mechanical connection between the shaft 7 and the gear wheel 5, so that the shaft 7 will cause the gear wheels 5 and 6 and thus the two cylinders 1 and 2 to rotate simultaneously and synchronously. This condition corresponds to normal operation of the machine.

In the illustrated embodiment, the element 11 consists of two parts, more precisely a first disk **11*a* provided with a central appendix 14*a* substantially semi-cylindrical in shape and provided with a slot 12*a*, and a second disk 11*b* coaxial to the first disk 11*a* and facing said first disk and provided with a substantially tubular appendix 15 on one side and with a substantially semi-cylindrical appendix 14*b* on the other side. The latter has a slot 12*b* similar and preferably symmetric to the slot 12*a*. Both disks are centrally provided with holes for positioning them on the corresponding part of the shaft 7. The second disk 11*b* is directly mounted on the shaft 7 with screws or the like 16 insertable in appropriate threaded holes 17 of the tubular appendix 15**, so that the two cylinders have their needle grooves in perfect alignment.

The disk **11*b* has on its periphery two spaced ears 18, which receive therebetween a tooth or the like, 19 of the disk 11*a*. The ears 18 are provided with screws 20, by means of which it is possible to adjust in a precise angular position the disk 11*a* with respect to the disk 11*b*, that is to vary slightly the angle between the slots 12*a* and 12*b*, the angle being preferably of 120°. As may be observed particularly in FIG. 4, the lower disk 11*b* has an annular rim 21 for housing the disk 11*a*, said rim also serving as a guide during the adjustment of the two disks and of the respective semi-cylindrical appendices 14*a* and 14*b***.

The dog 13 is formed in a single piece with the gear wheel 5.

The gear wheel 5 is advantageously formed in a single piece with a sleeve member 23 idly mounted and axially slidable with interposition of bushes or bearings 24 on the shaft 7. The member 23 is held, at diametrically opposite points, by the two ends 25 of a forked lever by means of pins 26 crossing the end 25 of the lever and carrying rollers 27 freely rotatable on the same pins. The lever extends perpendicularly to the plane of the drawing and is pivoted to the fixed part of the machine according to an axis parallel to the plane of the drawing. For reasons of clarity, it has been represented with a broken line and rotated by 90° in the drawings to make its operation more evident and it has been indicated with the numeral 28. Between the sleeve member 23 and a flange 30 situated in axially fixed position on the shaft 7, there is provided a spring 29 for forcing the gear wheel 5 and the dog 13 into engagement with the slot 12 of the flanged element 11 in normal machine operating conditions. The end of the lever 28 opposite the ends 25, is controlled by means of a rod and lever system responsive to the machine program and controlled by the machine control drum.

On the same plane of the gear wheel 5 there is furthermore provided a mobile plunger 31 controllably displaceable in a substantially radial direction with respect to the gear wheel 5 housed in a guide 32 mounted on the fixed structure of the machine. A pin 33, projecting from the plunger 31 and from a slit 34 of the guide 32, receives the end of a return spring 35 having the other end withheld by a catch 36 fixed to the structure of the machine. The control of the plunger 31 is carried out by means of a lever 37 which engages with the pin 33 and is pivoted to the fixed structure of the machine, the lever being controlled by the machine program. During normal operating conditions, the lever 37 is constantly displaced towards the right in FIG. 2 and the plunger 31 is disengaged from the teeth of the gear wheel 5.

When having to stop the upper needle cylinder 1 momentarily, during the closing of the toe being knitted, in order to carry out the torsion around the axis of the cylinders of the pocket previously formed, as was mentioned initially, a control signal given by the machine program to the levers 28 in the direction of the arrow F in FIG. 2 causes the lever to rotate and the gear wheel 5 to be raised to the position shown in FIG. 2, disengaging the dog 13 from the slot 12 of the flanged element 11, but leaving the gear wheel 5 in engagement with the crown gear 3. In this manner, the upper cylinder 1 is arrested, by no longer being mechanically connected to the drive shaft 7, while the lower cylinder 2 continues to rotate. To ensure that the cylinder 1 stops always in the same position, a control signal sent to the lever 37 by the machine program, releases the lever and causes the plunger 31 to move towards the gear wheel 5, causing the plunger 31 to penetrate between two adjacent teeth of the gear wheel 5 and thereby causing it to stop in a precise point every time.

Having carried out the torsion of the fabric, preferably by an angle of 240°, the machine program once again controls firstly the lever 37 and then the lever 28 in the opposite direction, causing the gear wheel 5 to return downwards (FIGS. 5 and 6) and the tooth 13 to engage with one of the slots 12. In particular, in order to obtain a 240° torsion, having a gear ratio such that at every revolution of the drive shaft 7 there corresponds a half revolution of the cylinders, the slots 12*a* and 12*b* are spaced by an angle of 120° so that the dog disengaged from the slot 12*b* (assuming that the drive shaft rotates in a clockwise direction), returns into the slot 12*a* after a rotation of 360° + 120° = 480°, that is after a rotation of the drive shaft 7 double that intended for the cylinders. In this manner, the upper cylinder 1 remains stationary through 240° and the slot 12*b* serves for normal knitting of the stocking before torsion and the slot 12*a* serves for normal knitting of the stocking with the upper cylinder out of phase by 240° for the final step of the knitting.

During this final step an elastic yarn may advantageously be knitted in addition to the normal yarn to form a few runproof courses for the purpose of fixing the closing of the toe. In order to facilitate the return to the inside of the runproof fabric, it is necessary to avoid an excessive constriction in the torsion area and for this purpose a pin 38 is provided in the knitting area around which the twisting takes place during the arrest of the upper cylinder 1.

The angular displacement between the slots 12*a* and 12*b*, may be adjusted rapidly in a fine and precise manner without the necessity of removing structural parts, so that even with the upper cylinder 1 rotated relative to the lower cylinder 2 it is possible to have the cylinder grooves perfectly aligned. Such an adjustment can always compensate for eventual wear with time, and which would not allow the alignment and would compromise the operation of the machine.

Advantageously, the dog 13 and the slot 12 have front faces 39 for engagement, which are exactly perpendicular to the plane of the disks 11*a* and 11*b*, and inclined rear faces 40. In this way, the dog 13 always penetrates, also as a result of the spring 29, inside the slots 12 without play. This is well visible in FIGS. 5 and 6, FIG. 5 showing the engagement between the dog 13 and the slot 12 when the engaging surfaces are not worn and FIG. 6 showing the engagement between the same elements when these are worn after a long period of operation.

With the described invention it is possible to reduce the wear of the mechanical parts involved in the engagement and disengagement of the upper cylinder 1 in that the coupling does not take place on small surfaces and close to the rotational axis, as in the case of the gear wheel or sliding sleeve member directly coupled to the drive shaft, but on larger surfaces and relatively removed from the rotational axis. Furthermore, with described invention it is always possible to correct rapidly and in a precise manner any wear which occurs over a period of time, thus maintaining the alignment of the needle grooves of the cylinders. In fact, wear occurs only between the dog 13 and the slots 12*a* and 12*b*, and this may be compensated for, while there is no wear between the flanged element 11 and the drive shaft 7, in that the connection is rigid, and the wear between gear wheel 5 and the drive shaft 7 is insignificant, in that the gear wheel is completely idle on the drive shaft.

The invention is susceptible to numerous modifications and variants, all falling within the scope of the inventive idea. Therefore it is possible to have the dog 13 on the flanged element 11 and the slot or slots 12 on the gear wheel 5. Obviously it is also possible to employ more than one dog 13 and a larger number of slots 12.

I claim:

1. A circular knitting machine for stockings with a lower and an upper support structure for knitting elements, said upper and lower support structure being rotationally operated by corresponding gear wheels arranged on a common drive shaft, and with a coupling joint between at least one of said gear wheels and said drive shaft, wherein said coupling joint comprises a substantially flanged element rigid with said drive shaft and provided with means for removable engagement with said one gear wheel and said one gear wheel is mounted idly and axially displaceable on said drive shaft, the machine further comprising means for the axial displacement of said one gear wheel to a position of disengagement from said substantially flanged element, said means being responsive to a machine program.

2. A machine as claimed in claim 1, wherein said substantially flanged element is provided with at least a slot and said one gear wheel is provided with at least a dog insertable within said slot.

3. A machine as claimed in claim 1, wherein said substantially flanged element has two slots angularly spaced on the front surface facing said gear wheel and said gear wheel is provided with a dog insertable within said slots, one of said slots being engaged by said dog during the normal rotation of said upper support structure and the other of said slots being engaged by said dog during the relative rotation of the upper support structure to said lower support structure.

4. A machine as claimed in claim 1, wherein said substantially flanged element consists of two coaxial disks facing each other both provided with two substantially semi-cylindrical appendices arranged contiguously and both provided with a slot, said disks being angularly adjustable with respect to each other to provide a fine adjustment of the angle between said slots.

5. A machine as claimed in claim 3, wherein said slots are arranged spaced by an angle of substantially 120°.

6. A machine as claimed in claim 1, further comprising a mobile plunger for the precision arrest of said one gear wheel, said plunger being controllably displaceable radially with respect to said one gear wheel and insertable between two adjacent teeth of said one gear wheel after disengagement between said substantially flanged element and said one gear wheel.

7. A machine as claimed in claim 1, wherein said one gear wheel is arranged on a sleeve member axially displaceable along said drive shaft by means of a lever pivoted to a fixed structure of the machine and controlled by a machine program.

8. A machine as claimed in claim 7, wherein said sleeve member is axially displaceable by such a distance as to disengage said one gear wheel from said substantially flanged element maintaining said one gear wheel in engagement with a crown gear provided for driving an upper support structure for knitting elements.

9. A machine as claimed in claim 2, wherein said dog and said slot have front engagement faces substantially perpendicular to the plane of said substantially flanged element and rear faces substantially inclined to compensate for play.

* * * * *